United States Patent [19]

Cousineau

[11] 4,450,919

[45] May 29, 1984

[54] DRILL ATTACHMENT

[76] Inventor: Bernard L. Cousineau, 345 N. Schiller, Palatine, Ill. 60067

[21] Appl. No.: 455,226

[22] Filed: Jan. 3, 1983

[51] Int. Cl.[3] ..... B21J 00/00; E02D 7/02

[52] U.S. Cl. ..... 173/29; 173/48; 173/916

[58] Field of Search ..... 173/29, 48, 93.6, 119; 279/93

[56] References Cited

U.S. PATENT DOCUMENTS

| | | | |
|---|---|---|---|
| 1,162,889 | 12/1935 | Thiele | 173/48 X |
| 1,656,054 | 1/1928 | Gage | 173/93.6 X |
| 2,016,829 | 10/1935 | Dederer | 173/119 |
| 2,223,727 | 12/1940 | Homen | 173/93.6 X |
| 2,923,191 | 2/1960 | Fulop | 173/93.6 X |
| 2,968,960 | 1/1961 | Fulop | 173/93.6 X |
| 3,000,225 | 9/1961 | Taylor | 173/48 X |
| 3,845,826 | 11/1974 | Beish | 173/109 X |
| 4,052,078 | 10/1977 | Beninetzki | 173/29 |
| 4,312,610 | 1/1982 | Burt | 408/26 X |

FOREIGN PATENT DOCUMENTS

| | | | |
|---|---|---|---|
| 2609466 | 9/1977 | Fed. Rep. of Germany | 173/93.6 |

*Primary Examiner*—E. R. Kazenske
*Assistant Examiner*—Willmon Fridie, Jr.
*Attorney, Agent, or Firm*—Mathew R. P. Perrone, Jr.

[57] ABSTRACT

A hammer adapter for a drill including a hammer assembly and a chuck assembly provides a hammering and drilling action for hard substrates by having a rotating spindle operatively connected to a reciprocating spindle to provide a drilling and hammering mechanism.

17 Claims, 10 Drawing Figures

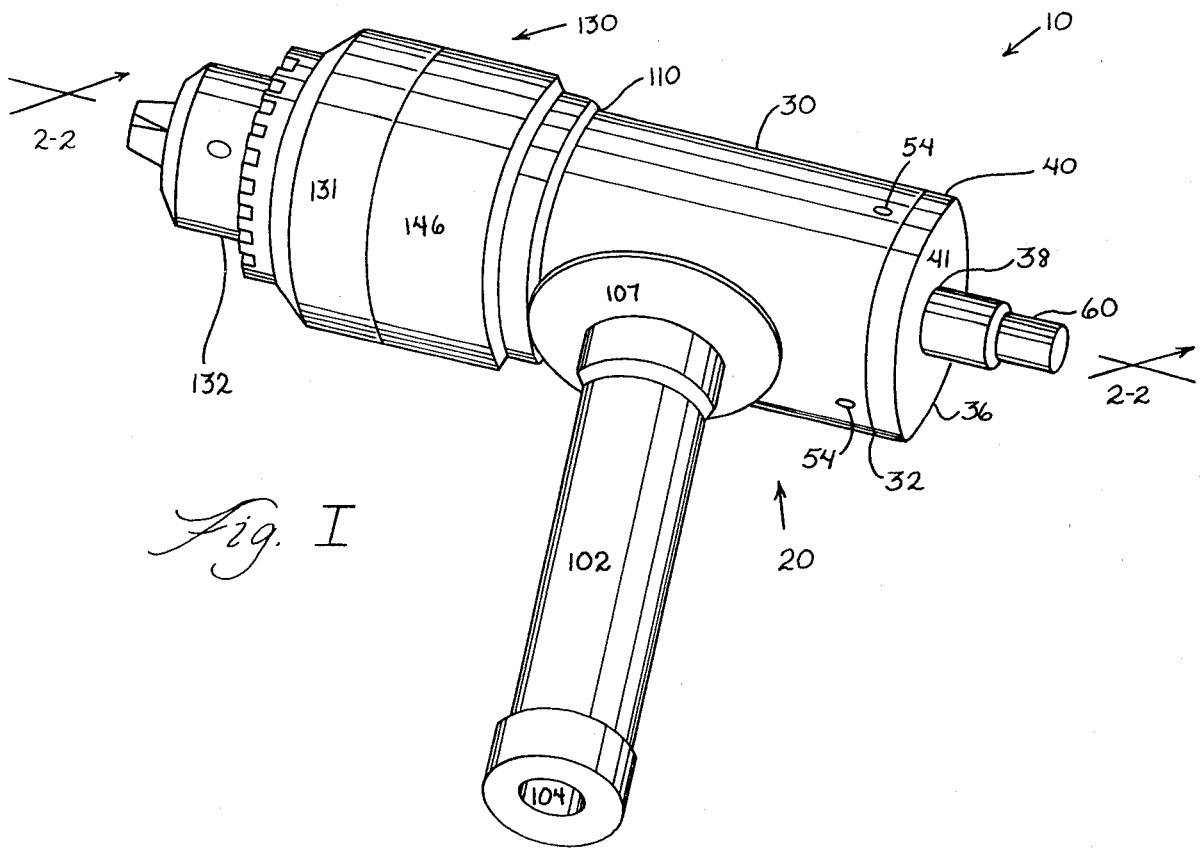
Fig. I
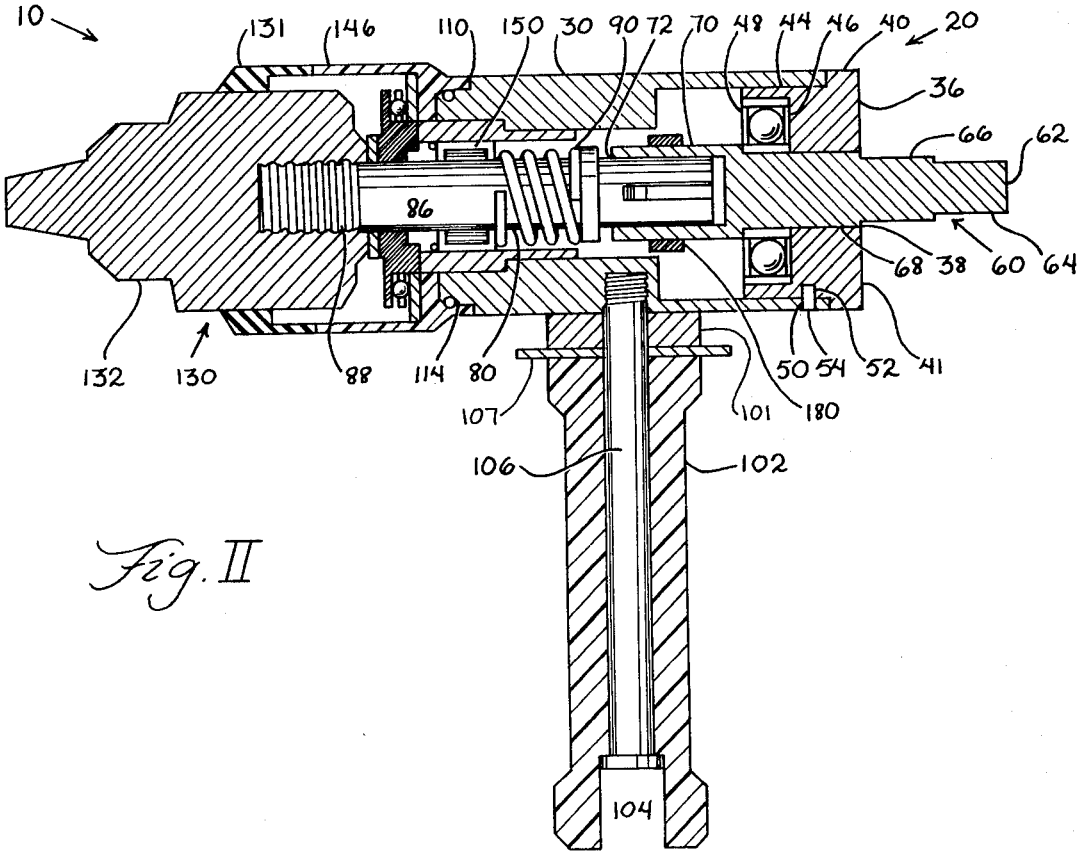
Fig. II

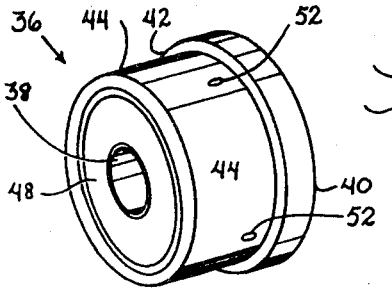
Fig. V
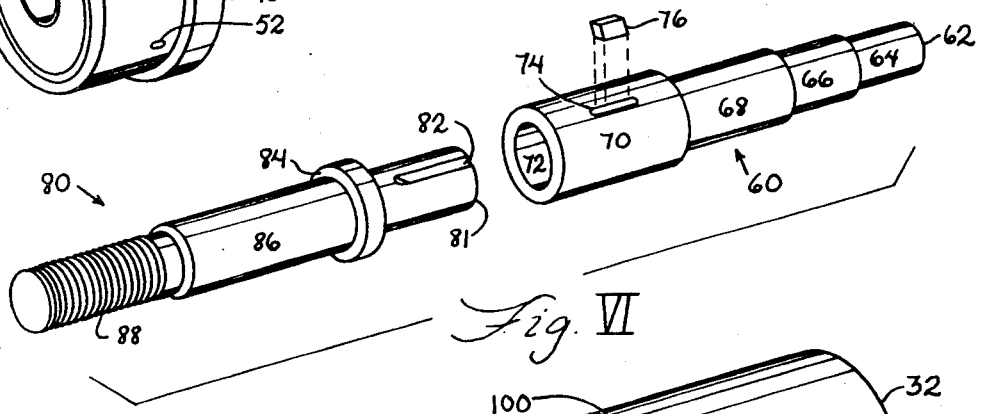
Fig. VI
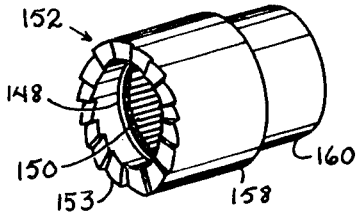
Fig. VII
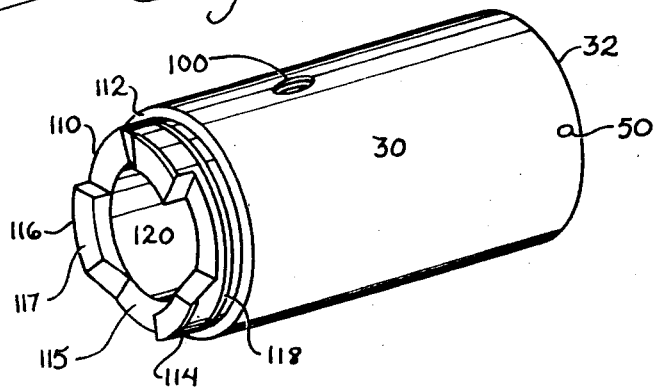
Fig. VIII
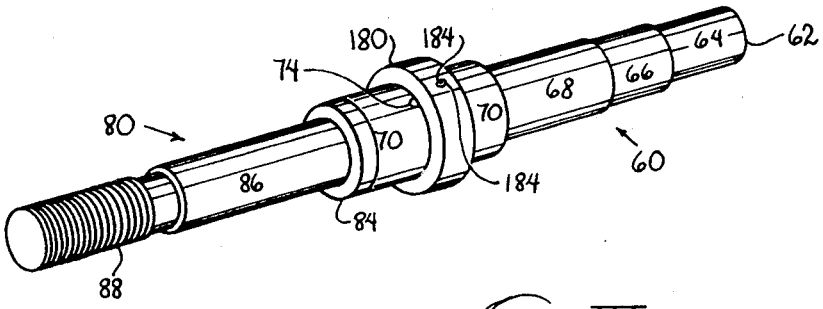
Fig. IX Fig. X
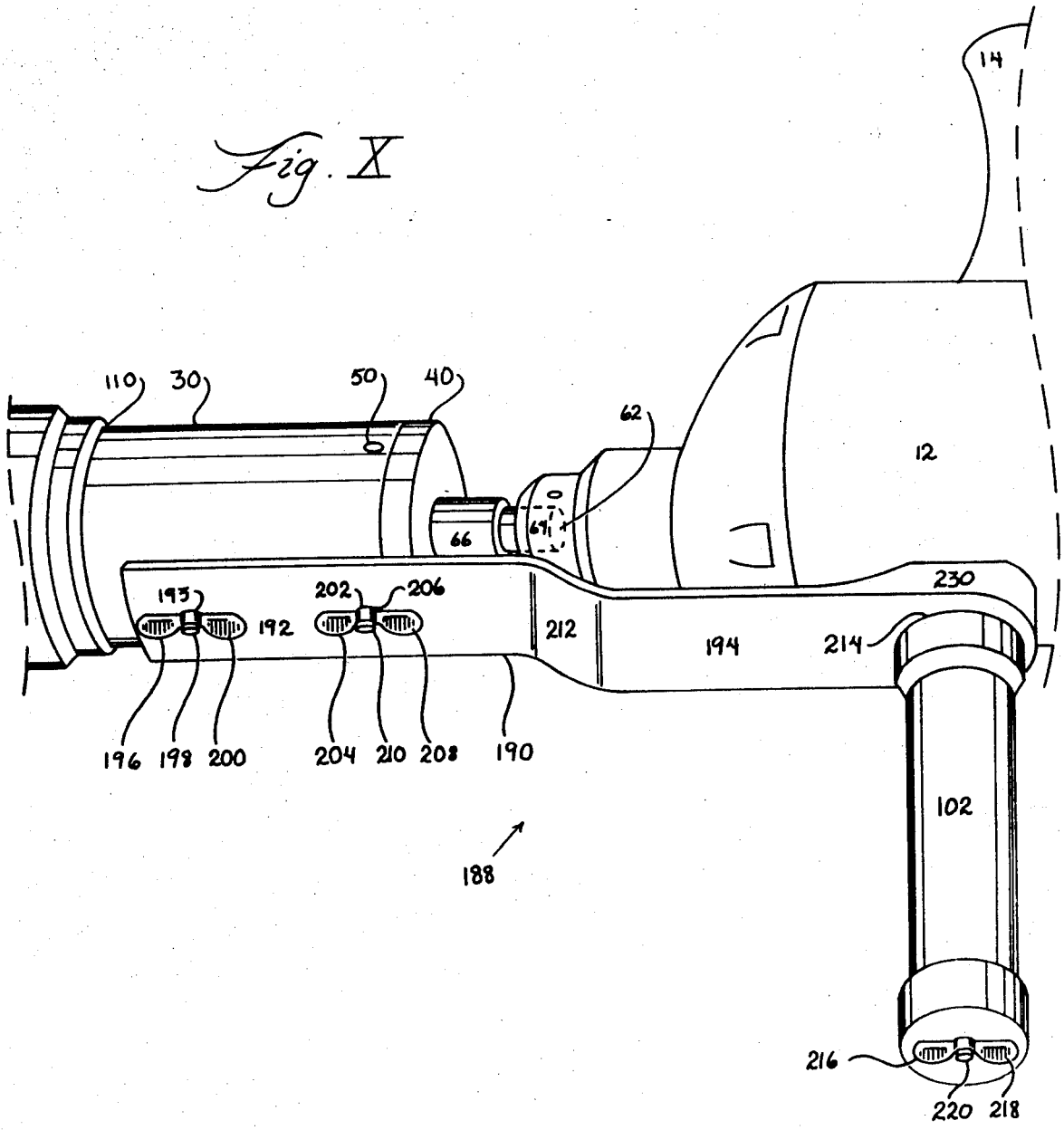

DRILL ATTACHMENT

BACKGROUND OF THE INVENTION

This invention relates to a device capable of being attached to a drill and more particularly to a device capable of being attached to a drill, such as an electric drill. This device can provide for both a hammering and drilling function to penetrate hard materials, or a drilling function alone.

Because of the need for forming apertures in a wide variety of substrates or other objects, a substantial number of devices for accomplishing that function is known. The different qualities of the substrates or objects appear to require this large number of devices. Some substrates or objects can have an aperture formed therein by a rotary drilling action. Other substrates or objects require a hammering action in order to have apertures formed therein. Still other substrates or objects require a combination of rotary and hammering action in order to have an aperture formed therein.

To a large extent rotary motion is so different from a hammering type motion that a different structure is required to produce each of the motions. Such a different structure either precludes the inclusion of both types of motion in one device, or requires devices having both types of motion to be either complicated, unreliable or both. Additionally, the more complicated devices are more expensive. These complexities cause even greater difficulty when one device is desired for use both as drilling mechanism alone, and as a joint drilling and hammering mechanism.

A particularly difficult problem exists when it is desired to form an aperture in a particularly hard substrate or object. Such particularly hard substrates or objects are exemplified by those made of concrete, masonry or similar materials. The materials which make up the particularly hard substrate or object generally require a combination of hammering and rotating action to achieve the desired aperture. Such combined action may be achieved by single tool or an adapter for a tool having only rotary capability.

If an adapter can be developed for use with a rotary drill, it becomes possible for a standard electric drill to achieve hammering and drilling capability. Furthermore, if the adapter can be changed to just a drilling function simply, great advantages are achieved. In this manner, the versatility of the drill is increased.

Thus, a device for permitting a drill to be adapted to hammer and drilling device can be a great advantage to the art.

SUMMARY OF THE INVENTION

Therefore, it is an object of this invention to provide a device which can adapt a drill to a hammering and rotating function.

A further object of this invention to provide a device for penetrating a hard substrate or object.

A still further object of this invention is to provide a device for forming an aperture in a hard substrate or object.

Yet a further object of this invention is to provide a simpilified device for forming an aperture in a hard substrate or object.

Also an object of this invention is to provide a reliable device for forming an aperture in a hard substrate or object.

Another object of this invention is to provide a less expensive device for forming an aperture in a hard substrate or object.

Still another object of this invention is to provide a device for adapting an electric drill for forming an aperture in a hard substrate or object.

Yet another object of this invention is to provide a simplified device capable of providing a joint drilling and hammering function.

A further object of this invention to provide a device capable of having a drilling function alone.

A still further object of this invention is to provide a device which is easily changed between a joint drilling and hammering function, and a drilling function alone.

These and other objects of this invention (which other objects become clear upon consideration of the specification as a whole) are met by providing a device which includes a hollow, tubular case having a reciprocating spindle operatively cooperating with a rotating spindle inside of the case at one end and secured to an exterior rotary power source at the other end.

BRIEF DESCRIPTION OF THE DRAWINGS

FIG. I is a perspective view of adapter 10 of this invention.

FIG. II is a cross-section of adapter 10 as shown in FIG. I taken along Line 2—2.

Figure 3:
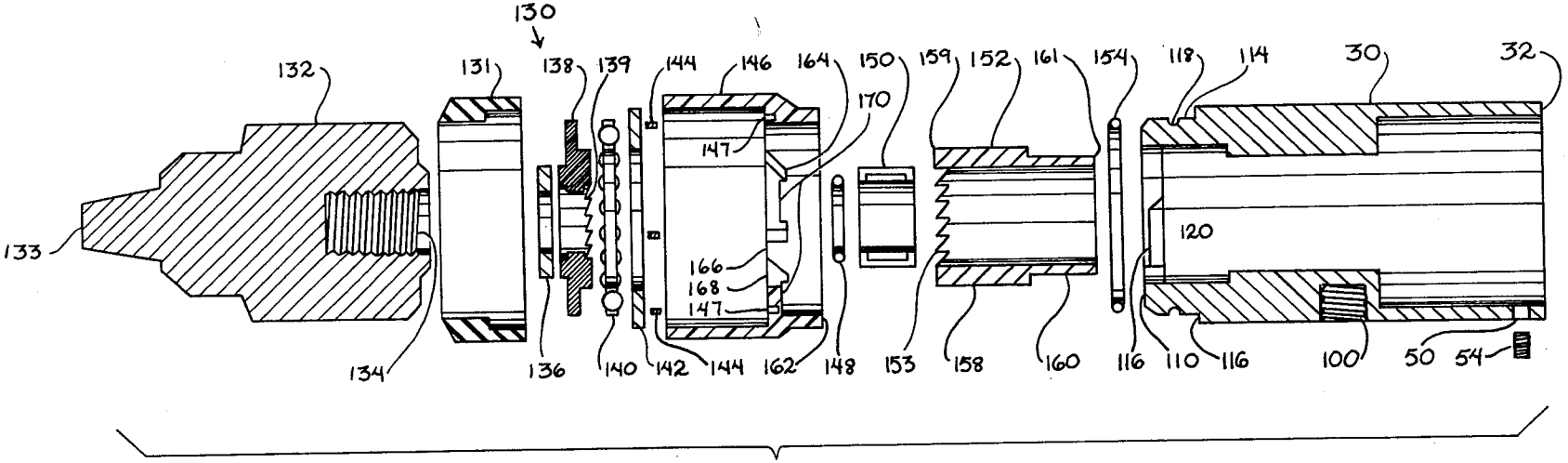
Figure 4:
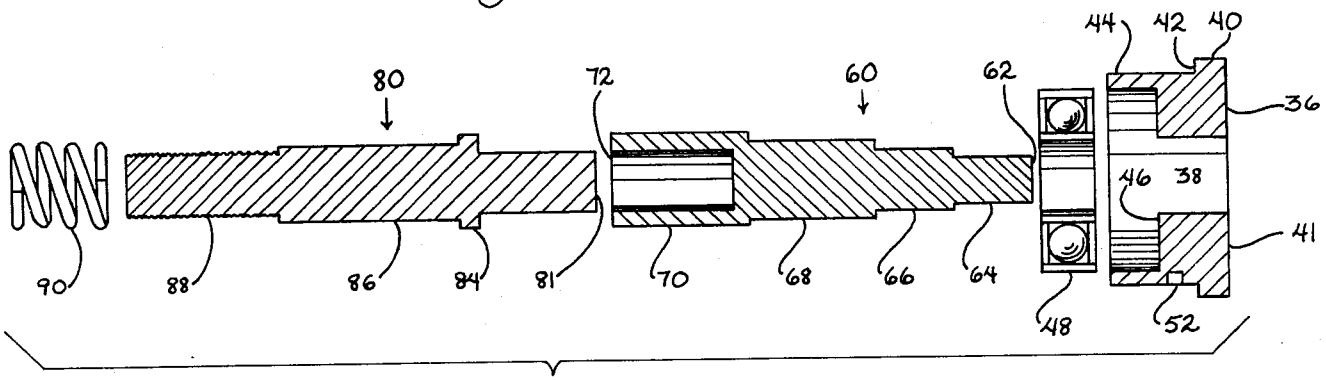

FIG. III depicts a cross-sectional, exploded view of adapter 10 of this invention showing most of the parts which comprise adapter 10.

FIG. IV depicts a cross-sectional exploded view of part of adapter 10 of this invention showing some of the parts which comprise hammer assembly 20.

FIG. V is a perspective view of cap 36.

FIG. VI is a perspective view of rotating spindle 60 and reciprocating spindle 80.

FIG. VII is a perspective view of stationery clutch 152 showing clutch teeth 153.

FIG. VIII is a perspective view of case 30 from chuck end 110.

FIG. IX is perspective view of rotating spindle 60 and reciprocating spindle 80 with spindle connector 180 in place.

FIG. X is perspective view of handle grip 102 secured to case 30 by bar mount 190.

Throughout the Figures of the Drawings, where the same part appears in more than one Figure of the drawing, the same number is assigned thereto.

DESCRIPTION OF THE PREFERRED EMBODIMENTS

This invention relates to a hammer attachment for use with a drill, and more particularly to a hammer attachment for the drill using a rotating spindle in combination with a sliding or reciprocating spindle to achieve the desired hammer action.

FIG. I depicts a perspective view of hammer attachment 10 including hammer assembly 20 and chuck assembly 130 operatively connected thereto. Chuck assembly 130 may be obtained from a number of manufacturers such as Black and Decker, Inc.; Milwaukee Tool, Inc.; and similar manufacturers.

Hammer assembly 20, as seen in FIG. I, shows case 30 with handle grip 102 secured thereto. Cap end 32 of case 30 has cap 36 secured thereto. Chuck end 110 is on case 30 and oppositely disposed from cap end 32. Chuck assembly 130 is secured to chuck end. Chuck assembly 130 includes the dust cover 131 fitting over drill chuck 132.

Referring now to FIG. II, which is a cross-section of FIG. I along Line 2—2, the relationship of various parts of hammer assembly 20 in assembled fashion is shown. Hammer assembly 20 includes case 30, which holds the parts thereof and forms a mounting base therefor. Case 30 is generally of a hollow, cylindrical shape.

Case 30 has a cap end 32 with a cap 36 secured thereto. Cap 36 is a unitary piece having a cap aperture 38 centrally located therein with cap grip 40 on the outer edge thereof. Cap grip 40 serves to provide a gripping point for inserting and removing cap 36 from case 30. Between cap grip 40 and cap aperture 38 is outer cap surface 41.

Substantially parallel to outer cap surface 41 and substantially perpendicular to cap grip 40 on cap 36 is case lip 42. Substantially perpendicular to case lip 42 and inside cap grip 40 is cap insert 44. Cap insert 44 slides in cap end 32 of case 30 and serves as a closing mechanism therefor. Inside of cap insert 44 is bearing support 46 for receiving bearing 48. Bearing 48 is shown as a ball bearing assembly, but may be other suitable bearing forms. Bearing 48 is pressed or otherwise secured in position.

Cap 36 is held in cap end 32 by using setscrew case apertures 50 in case 30 in alignment with setscrew cap apertures 52 in cap 36. Setscrews 54 are in threaded relation with each of the aligned setscrew case aperture 50 and setscrew cap aperture 52. One or more setscrews 54 and corresponding apertures may be used to hold cap 36 in place. Cap 36 may also be held in cap end 32 in any other suitable fashion, but the described fashion is preferred.

Rotating spindle 60 is adjacent cap end 32 and partially fits through cap aperture 38. Drill end 62 of rotating spindle 60 is exterior of hammer assembly 20 and appears on the outside of case 30 and cap 36. Drill end 62 includes drill grip 64 and grip support 66. Drill grip 64 may be secured to a suitable drill, such as an electric drill, so that hammer attachment 20 may be operated. Grip support 66 is between drill grip 64 and cap 36.

Rotating spindle 60 is generally cylindrical in nature. Grip support 66 has a slightly larger diameter than drill grip 64 and limits the insertion length for the suitable drill.

Adjacent grip support 66 and interior of case 30 is spindle cup support 68. Spindle cup support 68 is slideably and rotatably mounted in cap aperture 38 and ball bearing 48. Spindle cup 70 is adjacent spindle cup support 68 and may rest on cap insert 44. Spindle cup 70 has cup aperture 72 oppositely disposed from spindle cup support 68. Spindle cup support 68 provides closed end of spindle cup 70.

In the side (better shown in FIG. VI) of spindle cup 70 is key slot 74, which receives key 76. Key 76 cooperates with reciprocating spindle 80. Reciprocating spindle 80 has slotted end 81 with slot 82 which slideably mounts in spindle cup 70. Key 76 fits through key slot 74 and cooperates with slot 82 to provide the reciprocating action for hammer attachment 20. Reciprocating spindle 80 may both reciprocate and rotate for a combination drilling and hammering action, may only rotate for a drilling only action, when hammer attachment 20 is in operation.

On reciprocating spindle 80 adjacent slotted end 81 is cup support 84. Cup support 84 provides a limit of hammer action and defines how far slotted end 81 may reciprocate within spindle cup 70.

Oppositely disposed from slotted end 81 and adjacent cup support 84 is spring shaft 86. Adjacent spring shaft 86 and oppositely disposed from both cup support 84 and slotted end 81 is chuck mount 88. Chuck mount 88 receives chuck assembly 130.

Coil spring 90 surrounds spring shaft 86 and is between cup support 84 and chuck mount 88. Coil spring 90 combines with slotted end 81 and the related structure to provide the reciprocating capabilities desired for the combined hammer and drilling technique for penetrating hard surfaces.

Needle bearing 150 slides on spring shaft 86. Needle bearing 150 reduces the friction caused by the rotation of reciprocating spindle 80. Needle bearing 150 is situated on spring shaft 86 between coil spring 90 and chuck mount 88.

Within case 30 is case handle aperture 100 (also shown in FIG. VIII). Case handle aperture 100 is the mounting point for handle grip 102. Case handle aperture 100 is reinforced by case nut 101 being standardly secured to an exterior point of case 30 around handle aperture 100. Handle grip 102 is secured to case 30 by handle bolt receiver 104 therein being an aperture in handle grip 102 and having a central axis the same as the central axis of handle grip 102 and having bolt 106 passed therethrough into threaded relation with case aperture 100. Between handle grip 102 and case nut 101 is handle washer 107.

Handle grip 102 is firmly secured to case 30. Handle bolt 106 is passed through handle bolt receiver 104 and handle washer 107. Then handle bolt 106 is inserted through case nut 101 so that handle washer 107 is adjacent case nut 101. At that point, handle bolt 106 passes into threaded relation with case handle aperture 100, thereby securing handle grip 102 firmly to case 30.

Oppositely disposed from cap end 32 of case 30 is chuck end 110 (also shown in FIG. VIII). Chuck end 110 includes chuck ledge 112 for contact with chuck assembly 130. Chuck receiver 114 includes receiver base 115 with adjustable teeth 116 protruding therefrom (more clearly shown in FIG. VIII) for contact with chuck assembly 130. Adjustable teeth 116 have a top tooth surface 117. On chuck receiver 114 between adjustable teeth 116 and chuck ledge 112 is o-ring groove 118 for receiving o-ring 148 to help seal chuck assembly 130 to hammer attachment 20.

Referring now to FIG. III, which combines with FIG. IV to show a cross-section of FIG. I along Line 2—2, the relationship of various parts of hammer attachment 10 in unassembled fashion is shown. Hammer attachment 10 includes case 30, which holds the parts thereof and forms a mounting base therefor. Case 30 is generally of a hollow, cylindrical shape.

FIG. III shows an exploded view of chuck assembly 130 and a partial exploded view of hammer assembly 20. Chuck assembly 130 includes a dust cover 131, which slideably mounts over drill chuck 132. Drill chuck 132 may receive a drill bit (not shown) in bit end 133. On drill chuck 132, oppositely disposed from bit end 133 is spindle receiver 134. Chuck mount 88 mates in a threaded, male-female relationship with spindle receiver 134. Felt washer 136 is mounted on spring shaft 86 adjacent drill chuck 132.

A series of parts are mounted on or about spring shaft 86 between felt washer 136 and cup stop 84. These are generally parts of the chuck assembly 130. Any other suitable chuck assembly may be substituted for chuck assembly 130.

Chuck assembly 130 includes a clutch plate 138 adjacent felt washer 136 and around spring shaft 86. Adjacent clutch plate 138, which has clutch plate teeth 139 thereon, is thrust bearing retainer 140. Thrust washer 142 is adjacent thrust bearing retainer 140 at one side and rests on three small springs 144 on the other side thereof. Springs 144 are appropriately mounted in adjustable collar 146 in spring collar mounts 147. Seal 148 is adjacent thrust washer 144 and seals needle bearing 150 in stationery clutch 152. Needle bearing 150 rests on spring 90.

O-ring 154 fits in o-ring groove 118 on chuck receiver 114 to sealingly protect the juncture of chuck assembly 130 and hammer assembly 20.

Stationery clutch 152 is pressed into or machined into chuck end 110. Seal 148 seals needle bearing 150 into the stationery clutch 152 while the stationery clutch 152 is so assembled in chuck end 110. If stationery clutch 152 is pressed into chuck end 110, stationery clutch 152 is shaped to appropriately fit securely therein. In particular as shown to be preferred, clutch head 158 is the larger outside diameter 159 part of stationery clutch 152, while clutch base 160 is the smaller diameter part 161 of stationery clutch 152 and is appropriately shaped to achieve the diametric relationship. Clutch head 158 fits securely into clutch head receiver 120 at chuck end 110 due to the larger inside diameter of case 30 at chuck end 110. In a similar fashion, clutch base 160 fits securely into case 30.

As can be seen in FIG. II, spring 90 is adjacent the interior of clutch base 160 when hammer attachment 10 is assembled. An examination of FIG. II clearly shows the location of parts depicted in FIG. III and FIG. IV in a assembled fashion.

FIG. IV depicts cap 36, rotating spindle 60, bearing 48 and reciprocating spindle 80 in cross-section and spring 90 in an exploded view. Cap 36 is shown with setscrew cap aperture 52. Cap 36 includes cap grip 40, cap lip 42, cap insert 44, and bearing support 46 for receiving bearing 48.

Rotating spindle 60 shows drill end 62 with drill grip 64 and grip support 66. Between grip support 66 and spindle cup 70 is cup support 68. Spindle cup 70 receives slotted end 81 of reciprocating spindle 80 through spindle cup aperture 72. Cup stop 84 is adjacent slotted end 81. Spring shaft 86 is part of reciprocating spindle 80 between chuck mount 88 and cup stop 84. Spring 90 fits over spring shaft 86.

FIG. V, FIG. VI and FIG. VII combine to provide a perspective of view of the critical parts of hammer assembly 20. Hammer assembly 20 is an extremely critical part of hammer attachment as a whole and is by itself a unique device.

FIG. V depicts cap 36 in a perspective with bearing 48 pressed and sealed therein. Cap 36 is shown with setscrew cap apertures 52. Cap 36 further includes cap grip 40, cap lip 42, cap insert 44, and bearing 48. Cap grip 40 provides the gripping point for removing cap 36 from case 30. Perpendicular to cap grip 40 is case lip 42. Case lip 42 contacts cap end 32 of case 30 when cap 36 is inserted therein. Substantially perpendicular to case lip 42 is cap insert 44 which slides into case 30.

Within cap insert 44 is setscrew cap apertures 52, which cooperate with setscrew case apertures 50. Setscrews 54 pass through setscrew case apertures 50 into setscrew cap apertures 52 to secure cap 36 to case 30. Other means of securing cap 36 to case 30 are possible, but the setscrews 54 are preferred.

Bearing 48 is pressed or otherwise secured within cap insert 44. As thus assembled cap 30 provides strong support for hammer adapter 10, and specifically hammer assembly 20.

Referring now to FIG. VI, shown therein are rotating spindle 60, and reciprocating spindle 80. Rotating spindle 60 drill end 62 with drill grip 64 and grip support 66. Between grip support 66 and spindle cup 70 is cup support 68. Spindle cup 70 includes key receiver 74 in the side thereof and key 76 for fitting therethrough into slotted end 81 of reciprocating spindle 80 when spindle cup 70 receives slotted end 81 of reciprocating spindle 80 through cup aperture 72. Cup stop 84 is adjacent slotted end 81. Spring shaft 86 is part of reciprocating spindle 80 between chuck mount 88 and cup stop 84. Spring 90 fits over spring shaft 86.

Referring now to FIG. VII, stationery clutch 152 and case 30 are shown therein. Stationery clutch 152 has needle bearing 150 pressed and sealed therein. Clutch teeth 153 are provided to cooperate with clutch plate teeth 139.

Referring now to FIG. VIII, case 30 is shown in a perspective view from chuck end 110 looking toward cap end 32. In this fashion, chuck ledge 112 is shown. The bottom edge 162 of chuck assembly 130 rests on chuck ledge 112. Bottom edge 162 is part of adjustable collar 146 which is the female portion of male-female relationship between adjustable collar 146 and chuck receiver 114. Chuck receiver 114 is substantially perpendicular to chuck ledge 112.

Collar teeth 164 within collar 146 combine with adjustable teeth 116 to add the reciprocating action to the rotary action, or permit rotary action alone. Collar teeth 164 are mounted or secured on interior ledge 166 and protrude from ledge base 168. On the side of interior ledge 146 and oppositely disposed from collar teeth 146 are collar spring mounts 147. As collar teeth 164 protrude from ledge base 168, collar teeth surfaces 170 are formed. When collar teeth surface 170 are in contact with case top tooth surfaces 117, a pure drilling action is a achieved. When collar teeth surface 170 is in contact with receiver base 115, the combination of drilling and hammering (or reciprocating) is achieved.

Slot 82 is of sufficient length to permit adjustable collar 146 to be pulled and rotated to mesh with different teeth 116 to adjust the adapter so that the reciprocating or hammering stroke is added to or substracted from the drilling action when hammer attachment 10 is in use.

FIG. IX depicts an assembled version of FIG. VI. Rotating spindle 60 is assembled with reciprocating spindle 80. Slotted end 81 is inserted into spindle cup 70 at cup aperture 72. Key 76 fits into key slot 74 and slotted end 81, and is held therein by spindle connector 180.

Spindle connector 180 slides over spindle cup 70 and is positioned thereon by connector screw 182. Connector screw 182 fits through connector aperture 184 into threaded relation with spindle cup 70. Other assemblies of securing key 76 in place are also operable. The assemblies shown in FIG. IX are preferred.

FIG. X depicts a drill 12 secured to hammer attachment 10 at drill grip 64 and further includes a grip assembly 188 for attaching grip 102 to case 30. The grip assembly 188 of FIG. X provides for grip 102 to be adjacent the handle 14 of drill 12. Bar mount 190 has case end 192 secured to case 30 and grip end 194 with grip 102 secured thereto. Bar mount 190 is of sufficient length to have grip 102 adjacent drill handle 14.

Case end 192 is secured to case 30 using case handle aperture 100 (shown in FIG. VIII) in cooperation with first case end aperture 194 in case end 192. Winged attachment 196 includes a threaded portion 198 and a wing nut 200 secured to the threaded portion 198. Threaded portion 198 passes through the first case end aperture 193 in threaded or slideable relation therewith as may be desired into threaded relation with case handle aperture 100 to provide a first point for securing bar mount 190 to case 30.

A second point for securing bar mount 190 to case 30 is accomplished by second case end aperture 202, having a second winged attachment 204 passing therethrough into threaded relation with case 30 at a second case aperture 206. Second winged attachment 204 functions similarly and is structured similarly to winged attachment 196. In fact, winged attachment 196 and second winged attachment 204 may even be (but are not required to be) the same size.

Thus second winged attachment 204 includes second wing nut 208 and second threaded member 210. Second threaded member passes through second case end aperture 202 and into threaded relation with second case aperture 206. Second winged attachment 204 and winged attachment 196 cooperate to secure bar mount 190 to case 30.

Between second case end aperture 202 and grip end 194 of bar mount 190 is S-bend 212. S-bend 212 permits bar mount 190 to compensate for the different sizes of drill 12 and case 30 so that handle grip 102 can be situated adjacent drill handle 14.

Grip end 194 of bar mount 190 includes a thickened portion 230 having a threaded receiver 214 therein. Thickened portion 230 is thicker than S-bend 212 and case end 192 of bar mount 190. Winged handle attachment 216 passes through handle grip 102 and into threaded relation with threaded received 214 to secure handle grip 102 to grip end 194. Winged handle attachment 216 includes handle wing nut 218 secured to bar bolt 220.

Winged handle attachment 216, second winged attachment 204, and winged attachment 196 permit simplified changing of grip 102 from bar mount 190 to case 30 and back. Thus flexibility of hammer attachment 10 is increased.

In operation, hammer attachment 10 is secured at drill end 62 into a drill 12. A drill bit (not shown) of desired size is secured in drill chuck 132. When the drill 12 is operated, rotating spindle 60 rotates and imparts a rotary motion to reciprocating spindle 80 due to the action of key 76 in slot 82. Slot 82 permits reciprocating spindle 80 to reciprocate and provide the required hammer action to the drill 12. Spring 90 assists the reciprocating action and the return therefrom. Needle bearing 150 and ball bearing 48 provide for freer rotary movement. Clutch teeth 153 mesh with clutch plate teeth 139 and continue rotating function.

Suitable materials for making the hammer attachment 10 of this invention are determined by the use to which hammer attachment 10 is to be put. Generally case hardened steel or similar materials are preferred for the rotating spindle 60 and the reciprocating spindle 80. Such material provides the desired strength and durability. Similar considerations are used for determining appropriate materials for use in making of other parts of hammer attachment 10.

Because of the disclosure herein and solely because of the disclosure herein, certain modifications hereof can become apparent to those having ordinary skill in this art. Such modifications are clearly covered hereby.

What is claimed and sought to be secured by Letters Patent of the United States is:

1. A hammer assembly for a drill including a case, a hammer mechanism operatively mounted within said case and a handle secured to the exterior of said case, wherein:

a. said case is an elongated member having a closeable end at one end thereof and a bit end oppositely disposed from said closeable end;

b. said hammer mechanism includes a rotating member adjacent said closeable end partially within said case and partially outside of said case; wherein (1) said rotating member is a rotating spindle;

(2) said rotating spindle has a drill end through said drive aperture on an exterior of said case, and a receiving end oppositely disposed from said drill end in an interior of said case;

(3) said receiving end includes a hollow cylindrical portion open at a first end and closed at a second end, said second end being adjacent said drill end; and (4) a key slot in a side of said hollow cylindrical portion;

c. said hammer mechanism further includes a reciprocating member within said case having a connecting means at one end thereof for connecting said reciprocating member to said rotating member and a chuck securing means oppositely disposed from said connecting means, said chuck securing means serving to operatively connect a chuck assembly for holding a drill bit to said hammer assembly; wherein (1) said reciprocating member is a reciprocating spindle, (2) said reciprocating spindle has a slotted end and a threaded end oppositely disposed from said slotted end, and (3) said slotted end fits into said hollow cylindrical portion; and d. a handle securing means for securing a handle to said case.

2. The hammer assembly of claim 1 wherein said closeable end is a cap end, said hammer assembly further comprising:

a. a cap for removable closing said cap end;

b. a centrally located drive aperture within said cap;

c. said cap slideably mounted within said cap end;

d. a case stud aperture in said case adjacent said cap end; and e. a case stud inserted in said aperture to lock said cap on said cap end.

3. The hammer assembly of claim 2 wherein said cap has a generally cylindrical shape and includes a flat outer side, a gripping ridge perpendicular to said flat outer side on the outer edge thereof; a cap insert parallel to said gripping edge and interior thereto capable of mating in a male-female relationship with said cap end.

4. The hammer assembly of claim 3 wherein:

a. said hammer mechanism further includes a key fitting through said key slot and into said slotted end;

b. a stop means between said slotted end and said spring holder for limiting the insertion of said slotted end into said hollow cylindrical portion; and
c. a spring shaft as part of said reciprocating spindle between said stop means and said threaded end;
d. a spring around said spring holder;
e. a drill chuck assembly in threaded relation with said threaded end; and
f. a handle means secured to the exterior of said case.

5. The hammer assembly of claim 1 wherein:
a. said hammer mechanism is at least partially within said case and includes said rotating spindle and said reciprocating spindle and further comprises an assembly wherein:
(1) said rotating spindle has said drill end adjacent said closeable end at least partially exterior to said case, and a receiving end oppositely disposed from said drill end in said interior of said case;
(2) a key fitting into said key slot and said slotted end;
(3) a spring holder on said reciprocating spindle between said stop means and said threaded end;
(4) a stop means between said slotted end and said spring holder for limiting the insertion of said slotted end into said hollow cylindrical portion; and
(5) a spring around said spring holder;
b. a drill chuck assembly in threaded relation with said threaded end; and
c. a dust cover over said drill chuck assembly and said case.

6. The hammer assembly of claim 5 further comprising a separating means for separating a drilling function produced by said hammer attachment from a combined drilling and hammering function produced by said hammer attachment.

7. The hammer assembly of claim 6 wherein said separating means includes adjustable teeth on said bit end of said case cooperating with collar teeth, said collar teeth being an interior part of an adjustable collar, said adjustable collar being an exterior part of said chuck assembly; wherein a top surface of said collar teeth meet in an abutting fashion with a top surface of said adjustable teeth to provide said drilling function alone; and are released from said abutting fashion by movement of said adjustable collar to provide said combined drilling and hammering function.

8. The hammer assembly of claim 7 wherein said chuck assembly further comprises in sequence:
a. a drill chuck having a bit end for receiving a drill bit and a spindle receiving end oppositely disposed from said bit end;
b. a spindle receiving aperture in said spindle receiving end for receiving said threaded end of said reciprocating spindle;
c. an insulating and padding means adjacent said spindle receiving end; and
d. a clutch plate resting on said insulating and padding means;
e. a thrust bearing retainer supporting said clutch plate;
f. a washer supporting said thrust bearing;
g. a plurality of small springs having a washer end in contact with said washer and a collar end in contact with an equal plurality of small spring collar apertures within said adjustable collar;
h. said washer end being oppositely disposed from said said collar end; and
i. said adjustable collar containing therein said insulating and padding means, said clutch plate, said thrust bearing retainer, said thrust bearing, and said plurality of small springs.

9. A hammer adapter for an electric drill including a chuck assembly and a hammer assembly wherein said hammer assembly includes a case, a hammer mechanism operatively mounted within said case and a handle secured to the exterior of said case, and further wherein:
a. said case includes a hollow, tubular member having a cap end at one end thereof and a bit end oppositely disposed from said cap end and further comprises;
(1) a cap for removably closing said cap end;
(2) a centrally located drive aperture within said cap;
(3) said cap in threaded relation with said cap end;
(4) a case stud aperture in said case adjacent said cap end; and
(5) a case stud inserted in said aperture to lock said cap on said cap end;
b. said cap has a generally cylindrical shape and includes a flat outer side and further comprises;
(1) a gripping ridge perpendicular to said flat outer side, wherein the diameter across said flat outer side is substantially equal to the outside diameter of said case on the outer edge thereof; and
(2) a cap insert for insertion into said case parallel to said gripping edge and interior thereto capable of mating in a male-female relationship with said cap end;
c. said hammer mechanism includes a rotating spindle and reciprocating spindle and further comprises;
(1) said rotating spindle has a drill end through said drive aperture on an exterior of said case, and a receiving end oppositely disposed from said drill end in an interior of said case;
(2) said receiving end includes a hollow cylindrical portion open at a first end and closed at a second end, said second end being adjacent said drill end;
(3) a key slot in said hollow cylindrical portion;
(4) said reciprocating spindle has a slotted end and a threaded end oppositely disposed from said slotted end;
(5) said slotted end fitting into said hollow cylindrical portion;
(6) a key fitting into said key slot and said slotted end;
(7) a stop means between said slotted end and said threaded end for limiting the insertion of said slotted end into said hollow cylindrical portion;
(8) a spring holder on said reciprocating spindle between said stop means and said threaded end; and
(9) a spring around said threaded end on said spring holder;
d. a drill chuck assembly in threaded relation with said threaded end including an adjusting collar as an exterior part thereof;
(1) said drill chuck having a bit end for receiving a drill bit and a spindle receiving end oppositely disposed from said bit end;
(2) a spindle receiving aperture in said spindle receiving end for receiving said threaded end of said reciprocating spindle;

(3) an insulating and padding means adjacent said spindle receiving end; and
(4) a clutch plate resting on said insulating and padding means;
(5) a thrust bearing retainer supporting said clutch plate;
(6) a washer supporting said thrust bearing;
(7) a plurality of small springs having a washer end in contact with said washer and a collar end in contact with an equal plurality of small spring collar apertures;
(8) said washer end being oppositely disposed from said collar end; and
(9) said adjusting collar having therein in an assembled fashion said insulating and padding means, said clutch plate, said thrust bearing retainer, said thrust bearing, and said plurality of small springs; and e. a handle means secured to the exterior of said case.

10. The hammer adapter of claim 9 wherein said handle means is secured to the exterior of said case at an grip aperture formed in the exterior of said case and further wherein:

(a) said grip aperture is reinforced by a nut secured to said case around said grip aperture;
(b) a washer is adjacent said nut and opposite said case;
(c) a cylindrical grip having a axial aperture therethrough is adjacent said washer; and
(d) a bolt passes through said cylindrical grip at said axial aperture, through said washer and through said nut into threaded relation with said grip aperture.

11. The hammer adapter of claim 9 wherein said handle means is secured to the exterior of said case at an grip aperture formed in the exterior of said case and further wherein:

(a) a bar mount having a case end and a grip end is secured to said case at said grip aperture;
(b) said case end and said grip end are oppositely disposed;
(c) an S-bend is on said bar mount between said case end and said grip end, said S-bend serving to permit said grip end to be adjacent a drill; and
(d) said case end has therein at least one case end aperture capable of receiving a case bolt therethrough into threaded relation with said grip aperture.

12. The hammer adapter of claim 11 wherein:

(a) said grip end is thicker than said case end;
(b) a threaded receiver within said grip end for receiving a handle bolt in threaded relation therewith; and
(c) a cylindrical grip having an axial aperture therethrough for receiving said handle bolt to thereby hold said cylindrical grip to said grip end.

13. The hammer adapter of claim 12 wherein each of said handle bolt and said case bolt have a hand-operable nut secured thereto for removing or securing handle bolt and said case bolt.

14. The hammer adapter of claim 13 wherein said hand-operable nut is a wing nut.

15. The hammer adapter of claim 9 wherein said cap is in threaded relation with said case.

16. The hammer adapter of claim 9 wherein a key holder is secured over said key and said key slot to hold said key in said slot.

17. The hammer adapter of claim 16 wherein said key holder is an annular ring around said hollow cylindrical portion.

* * * * *